US005219110A

United States Patent [19]

Mukoyama

[11] Patent Number: 5,219,110

[45] Date of Patent: Jun. 15, 1993

[54] MECHANISM FOR ADJUSTING DRIVING DEPTH OF FASTENERS IN FASTENER DRIVING TOOL

[75] Inventor: Kenji Mukoyama, Anjo, Japan

[73] Assignee: Makita Corporation, Anjo, Japan

[21] Appl. No.: 946,901

[22] Filed: Sep. 18, 1992

[30] Foreign Application Priority Data

Sep. 21, 1991 [JP] Japan ..... 3-84728[U]

[51] Int. Cl.[5] ..... B25C 1/04

[52] U.S. Cl. ..... 227/8; 227/142

[58] Field of Search ..... 227/8, 142

[56] References Cited

U.S. PATENT DOCUMENTS

| | | | |
|---|---|---|---|
| 3,204,400 | 9/1965 | Kvavle | 227/8 |
| 3,519,186 | 7/1970 | Volkmann | 227/8 |
| 4,767,043 | 8/1988 | Canlas, Jr. | 227/8 |
| 4,821,937 | 4/1989 | Rafferty | 227/142 |

FOREIGN PATENT DOCUMENTS

| | | | |
|---|---|---|---|
| 60-117072 | 7/1985 | Japan . | |
| 398308 | 9/1933 | United Kingdom | 227/142 |

*Primary Examiner*—Scott Smith

*Attorney, Agent, or Firm*—Dennison, Meserole, Pollack & Scheiner

[57] ABSTRACT

A fastener driving tool includes a driver guide within which a driver is reciprocally moved to drive the fasteners, a contact arm vertically movable along the driver guide and having a lower end for abutment on a work, a control mechanism interlocked with the contact arm for controlling operation of the driver. A mechanism for adjusting driving depth of the fasteners includes a cam device interposed between an upper part and a lower part of the contact arm. The lower part has the lower end for abutting on the work. The cam device is operable by an operator for varying distance between the upper part and the lower part of the contact arm.

5 Claims, 4 Drawing Sheets

MECHANISM FOR ADJUSTING DRIVING DEPTH OF FASTENERS IN FASTENER DRIVING TOOL

BACKGROUND OF THE INVENTION

1. Field of the Invention

The present invention relates to a mechanism for adjusting driving depth of fasteners such as nails in a fastener driving tool.

2. Description of the Prior Art

A conventional fastener driving tool includes a driver guide within which a driver is reciprocally driven for driving fasteners, a contact arm vertically movable along the driver guide and having a lower end for abutting on a work, and a control mechanism operably connected to the contact arm for controlling a driving operation of the driver. A mechanism is interlocked with the contact arm for adjusting the driving depth of fasteners into the work.

Japanese Utility Model Publication No. 60-117072 discloses an adjusting mechanism utilizing a threaded member connecting an upper part of a contact arm with a lower part thereof so as to permit change of vertical stroke of the lower part.

However, the prior art adjusting mechanism requires to rotate the threaded member for each changing operation. Further, since the adjusting mechanism is disposed along the driver guide having relatively smaller size than the body of the fastener driving tool, the operation of the threaded member is very troublesome. In addition, this mechanism requires an additional mechanism for preventing the threaded member from being loosened so as to maintain its set position. This may result in increased number of parts.

SUMMARY OF THE INVENTION

It is, accordingly, an object of the present invention to provide a mechanism for adjusting driving depth of fasteners in a fastener driving tool which can be easily and reliably operated to adjust the driving depth.

According to the present invention, there is provided a mechanism for adjusting driving depth of fasteners in a fastener driving tool including a driver guide within which a driver is reciprocally moved to drive the fasteners, a contact arm vertically movable along the driver guide and having a lower end for abutment on a work, a control mechanism interlocked with the contact arm for controlling operation of the driver. The mechanism for adjusting driving depth comprises a cam device interposed between an upper part and a lower part of the contact arm, the lower part having the lower end for abutting on the work, the cam device being operable by an operator for varying distance between the upper part and the lower part of the contact arm.

The invention will become more fully apparent from the claims and the description as it proceeds in connection with the drawings.

DETAILED DESCRIPTION OF THE PREFERRED EMBODIMENT

Figure 1:
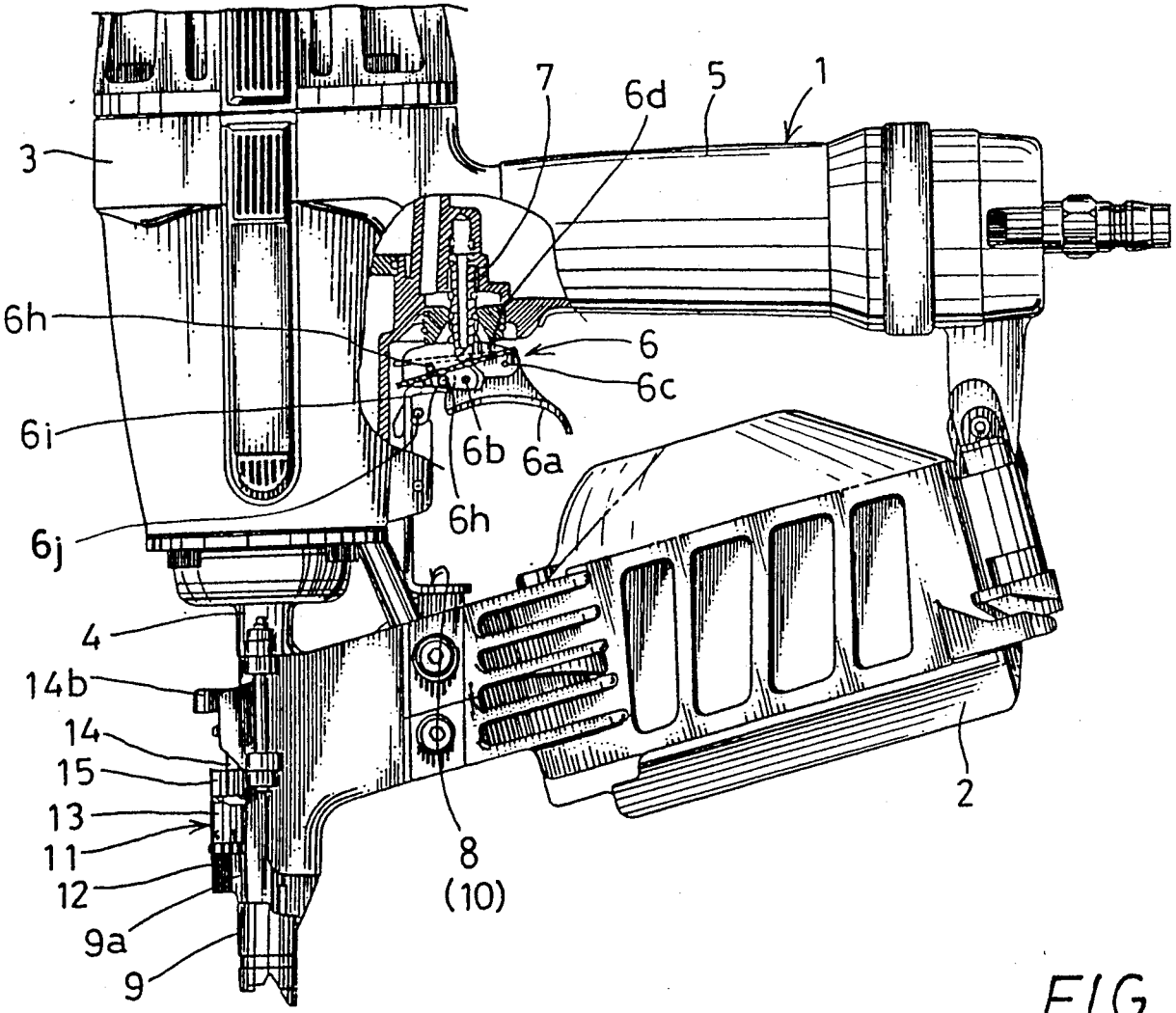
FIG. 1 is a side view, with a part broken away, of a fastener driving tool including a mechanism for adjusting driving depth of fasteners according to an embodiment of the present invention.
Figure 2:
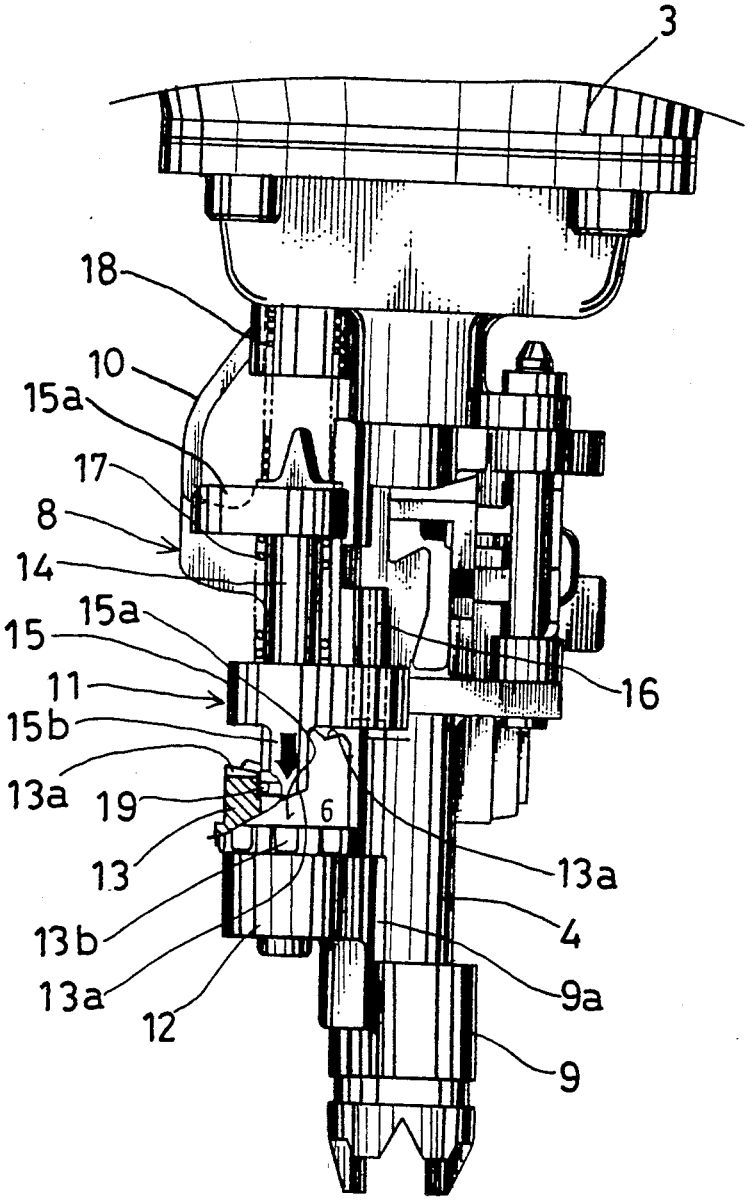
FIG. 2 is an enlarged front view of a lower portion of the fastener driving tool shown in FIG. 1.
Figure 3:
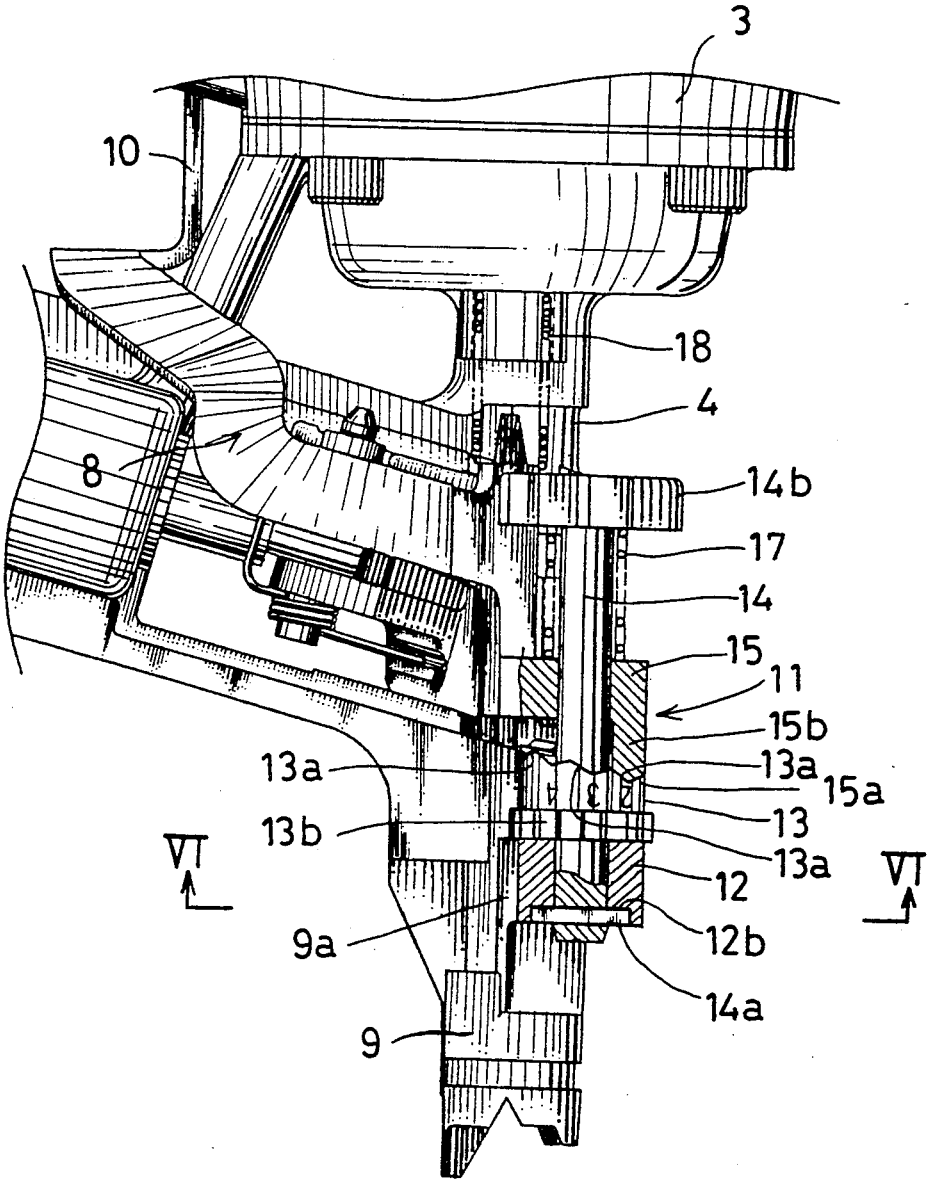
FIG. 3 is a side view of FIG. 2.
Figure 4:
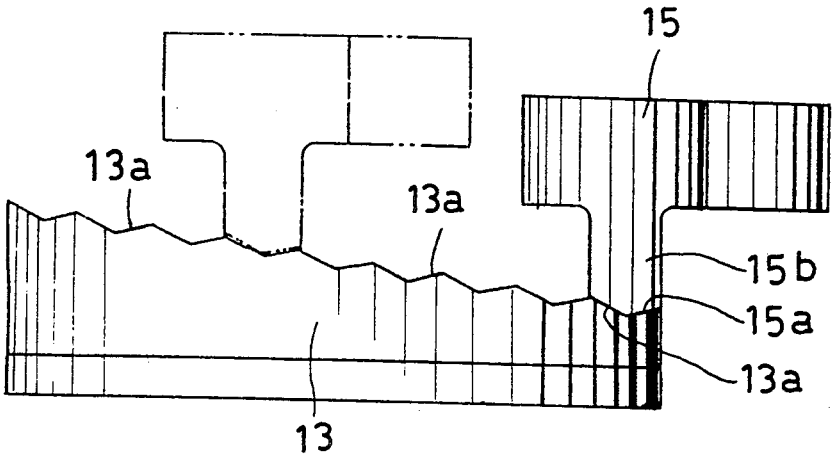
FIG. 4 is a schametic view of an upper and a lower cam member shown in FIG. 1 with the lower cam member shown in developed form.
Figure 5:
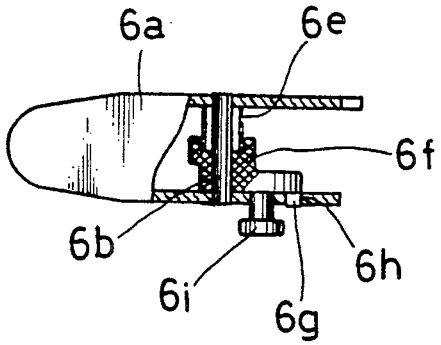
FIG. 5 is a bottom view, with a part broken away, of a trigger shown in FIG. 1.
Figure 6:
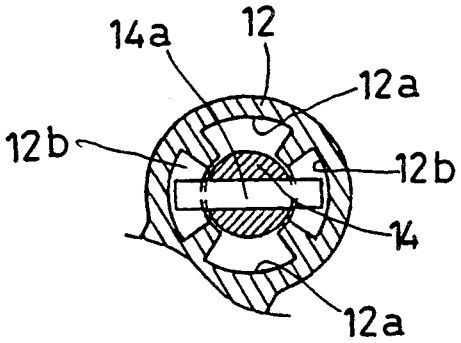
FIG. 6 is a sectional view taken along line VI—VI in FIG. 3.

Referring to FIG. 1, there is shown a fastener driving tool 1 including a driving depth adjusting mechanism according to an embodiment of the present invention. The fastener driving tool 1 is constructed to reciprocally move a piston (not shown) within a body 3 through a compressed air supplied from an air source. The piston is connected to a driver (not shown) movable along a driver guide track (not shown) formed in a driver guide 4 which is mounted on a lower portion of the body 3. The driver drives fasteners fed from a magazine 2 one after another. A handle 5 is connected to the central portion of the body 3 and extending substantially perpendicular to the body 3.

A trigger mechanism 6 is mounted on the body 3 at a position adjacent the handle 5 and includes a trigger **6*a* pivotally supported by the body 3 through a shaft 6*j*. The trigger 6*a* is operable by an operator for actuation of a trigger valve 7 which governs the compressed air for movement of the piston. The trigger mechanism 6 further includes an operation member 6*d* having one end pivotally supported by the trigger 6*a* through a pin 6*c*. The operation member 6*d* is positioned in opposed relationship with the trigger valve 7. A cam plate 6*f* is disposed below the operation member 6*d*. One end of the cam plate 6*f* is pivotally supported by the trigger 6*a* through a pin 6*b* disposed forwardly of the pin 6*c*. The other end of the cam plate 6*f* includes a pin 6*g* which can be selectively engaged into holes 6*h* formed in one of side plates of the trigger 6*a*. The cam plate 6*f* is biased by a spring 6*e* in an axial direction of the pin 6*b* so as to be pressed on the side plate of the trigger 6*a*. A knob 6*i* is mounted on the cam plate 6*f* for operation by the operator. With this construction, when the pin 6*g* is engaged into one of the holes 6*h* disposed at a lower position, the operation member 6*d* is supported by the cam plate 6*f* at a first Position shown by a solid line in FIG. 1. When the pin 6*g* is engaged into the other of the holes 6*h* disposed at a higher position, the operation member is supported by the cam plate 6*f* at a second position shown by a dotted line in FIG. 1. The operation member 6*d* at the first position prevents the trigger 6*a* from actuating the trigger valve 7 while the operation member 6*d* at the second position permits the trigger 6*a* to actuate the trigger valve 7**.

A contact arm 8 is disposed along the driver guide 4 and includes a lower part 9 and an upper part 10. The lower part 9 is of a substantially cylindrical configuration and is slidably movable along the driver guide 4 in a vertical direction. The upper part 10 is of a bent arm-like configuration and includes an upper end disposed in opposed relationship with the other end of the operation member **6*d* of the trigger 9*a*. When the contact arm 8 is moved upwardly, the operation member 6*d* is pivoted upwardly to a position where the trigger valve 7 can be actuated by the trigger 6*a* through the operation member 6*d*. Thus, the trigger valve 7 can be actuated irrespective of the position of the cam plate 6*f***.

A mechanism 11 for adjusting driving depth of fasteners is provided between the lower part 9 and the upper part 10 and includes a cylindrical lower cam member 13. The lower cam member 13 is supported by a cylindrical support member 12 connected to the lower part 9 through a leg 9*a* which extends upwardly from the lower part 9 along the driver guide 4. The lower cam member 13 includes on its upper end surface a plurality of saw tooth-like cam recesses 13*a* formed in series in a circumferential direction. The cam recesses 13*a* are of substantially the same configuration but gradually change the level of their bottoms in a circumferential direction. The lower portion of the lower cam member 13 is slightly expanded outwardly to form a knob 13*b* for operation by the operator. Further, the lower cam member 13 has on its outer surface an indication of gauge corresponding to the level of the bottom of each of the cam recesses 13*a*. The inner wall of the support member 12 includes a pair of recesses 12*a* which are diametrically opposed to each other and which are opened at their upper and lower ends, respectively. The inner wall of the support member 12 further includes a pair of engaging recesses 12*b* which are diametrically opposed to each other and which have closed upper ends and opened lower ends, respectively. The engaging recesses 12*b* are displaced from the recesses 12*a* by an angle of about 90° in a circumferential direction. A support shaft 14 is slidably inserted into the support member 12 and the lower cam member 13. A pin 14*a* is fixed to the lower end of the support shaft 14 in a direction perpendicular to the axial direction of the support shaft 14. Both ends of the pin 14*a* extend radially outwardly from the support shaft 14. The pin 14*a* prevents the support shaft 14 from removing upwardly from the support member 12 when the ends of the pin 14*a* are engaged with the engaging recesses 12*b*. The pin 14*a* permits removal of the support shaft 14 from the support member 12 when the ends of the pin 14*a* are engaged with the recesses 12*a* through rotation of the support shaft 14 by an angle of about 90°. A knob 14*b* is mounted on an upper end of the support shaft 14 for operation of the support shaft 14. An O-ring 19 is mounted on the support shaft 14 to provide an appropriate frictional resistance between the support shaft 14 and the lower cam member 13.

A cylindrical upper cam member 15 is fixed to the lower end of the upper part 10 of the contact arm 8. The upper cam member 15 is vertically slidably fitted on the support shaft 14. A guide member 16 is integrally formed with the driver guide 4 for guiding the upper cam member 15 in the vertical direction and for preventing rotation thereof relative to the driver guide 4. The upper cam member 15 includes a protrusion 15*b* extending downwardly therefrom. The protrusion 15*b* includes at its lower end a cam surface 15*a* of a configuration corresponding to that of each of the cam recesses 13*a* of the lower cam member 13 for engagement therewith.

A first spring 17 is interposed between the knob 14*b* of the support shaft 14 and the upper surface of the upper cam member 15 for normally biasing the support shaft 14 upwardly. A second spring 18 is interposed between the bottom surface of the body 3 and a part of the upper part 10 adjacent the driver guide 4 for normally biasing the upper part 10 in a downward direction.

The operation of the above embodiment will now be explained. For driving operation of the fasteners, the operator holds the fastener driving tool 1 with the handle 5 grasped by his hand and moves it downwardly toward the work so as to bring the driver guide 4 to abut on the work. Prior to abutment of the driver guide 4 on the work, the lower part 9 of the contact arm 8 abuts on the work, so that the contact arm 8 is lifted to pivot the operation member 6*d* of the trigger mechanism 6 upwardly so as to permit actuation of the trigger valve 6*a* by the trigger 6*a* for driving fasteners from the driver guide 4.

The lifting movement of the contact arm 8 is performed in such a manner that the lower part g is moved upwardly along the driver guide 4, together with the support member 12, the lower cam member 13, the upper cam member 15 and the upper part 10 of the contact arm 8 against the biasing force of the second spring 18. The support shaft 14 is also moved upwardly together with them with the aid of the biasing force of the first spring 17 and the pin 14*a* of the support shaft 14 is kept in engagement with engaging recesses 12*b* of the support member 12.

For adjusting driving depth of the fasteners, the operator presses the support shaft 14 downwardly against the force of the first spring 17 through the knob 14*b*. Since the frictional force is provided between the support shaft 14 and the lower cam member 13 by the O-ring 19, the lower cam member 13 is moved downwardly together with the support member 12 of the lower part 19. This may cause disengagement of the cam surface 15*a* of the upper cam member 15 from any one of the cam recesses 13*a* of the lower cam member 13 with which the cam surface 15*a* has been previously engaged.

At this stage, the operator rotates the lower cam member 13 relative to the support shaft 14 so as to position the selected one of the cam recess 13*a* corresponding to the desired driving depth in opposed relationship with the cam surface 15*a* of the upper cam member 15. Upon releasing the pressing force on the support shaft 14, the support shaft 14 is moved upwardly by the biasing force of the first spring 17, and the lower cam member 13 is subsequently moved upwardly together with the support member 12. The cam surface 15*a* is thus engaged with the selected one of the cam recesses 13*a*, so that the amount of extension of the end of the lower part 9 beyond the lower end of the driver guide 4.

For obtaining a shorter driving depth, the cam surface 15*a* of the upper cam member 15 is engaged with the selected one of the cam recesses 13*a* positioned at a higher level so as to provide a larger amount of extension of the lower part 9 beyond the driver guide 4. On the other hand, for obtaining a longer driving depth, the cam surface 15*a* is engaged with the selected one of the cam recesses 13*a* positioned at a lower level so as to provide a smaller amount of extension of the lower part 9.

As described above, the operation for adjusting driving depth can be performed by rotating the lower cam member 13. Such operation is simple and can be easily performed. Further, the adjustment can be reliably Performed through engagement of the cam surface 15*a* with the selected one of the cam recesses 13*a*.

Additionally, the support shaft 14 is prevented from removal from the support member 12 through engagement of the pin 14*a* with the engaging recesses 12*b* of the support member 12 while the support shaft 14 can be easily removed from the support member 12 through rotation by an angle of 90° so as to position the pin 14*a* to engage the recesses 12*a*. This may make it easy to disassemble or assemble various parts of the contact arm 8 for changing the lower part 9 to another one. Further, the lower part 9 can be changed without requiring change of the other parts.

While the invention has been described with reference to a preferred embodiment thereof, it is to be understood that modifications or variations may be easily made without departing from the scope of the present invention which is defined by the appended claims.

What is claimed is:

1. In a fastener driving tool including a driver guide within which a driver is reciprocally moved to drive the fasteners, a contact arm vertically movable along the driver guide and having a lower end for abutment on a work, a control mechanism interlocked with the contact arm for controlling operation of the driver;

a mechanism for adjusting the driving depth of fasteners comprising cam means interposed between an upper part and a lower part of the contact arm, the lower part having said lower end for abutting on the work, and said cam means being operable by an operator for varying the distance between said upper part and said lower part of the contact arm, said cam means include a first cam member and a second cam member disposed in opposed relationship with each other and rotatable relative to each other; said first cam member and said second cam member include a first cam surface and a second cam surface, respectively; said first cam surface and said second cam surface are engageable with each other, the distance between an upper surface of said first cam member and a lower surface of said second cam member being variable according to rotation of said first and second cam member relative to each other; biasing means for biasing one of said first and said second cam member to engage said first and second cam surface and wherein said second cam surface is of annular configuration and includes a plurality of cam recesses having a different bottom height which gradually changes in a circumferential direction; said first cam surface is of convex configuration and is engageable with any of said cam recesses.

2. The mechanism as defined in claim 1 wherein said first cam member is integrally formed with the upper part of the contact arm; and said second cam member is rotatable around a support shaft mounted on the lower part of the contact arm.

3. The mechanism as defined in claim 2 wherein said support shaft is mounted on a support member integrally formed with the lower part of the contact arm; and said second cam member is disposed on said support member.

4. The mechanism as defined in claim 3 wherein said support shaft is slidably inserted into the first cam member and extending upwardly therefrom; a knob is mounted on an upper end of the support shaft; and said biasing means is a spring interposed between said knob and an upper surface of said first cam member so as to bias the lower part upwardly together with said second cam member through said support shaft.

5. In a fastener driving tool including a driver guide within which a driver is reciprocally moved to drive the fasteners, a contact arm vertically moved along the driver guide and having a lower end for abutment on a work, a control mechanism interlocked with the contact arm for controlling operation of the driver;

a mechanism for adjusting driving depth of the fasteners comprising:

cam means interposed between an upper part and a lower part of the contact arm and operable by an operator or varying the distance between said upper part and said lower part of said contact arm, said lower part having the lower end for abutting on the work;

said cam means including a first cam member and a second cam member movable toward and away from each other in the vertical direction and rotatable relative to each other;

said first cam member and said second cam member having a first cam surface and a second cam surface, respectively, which are engageable with each other, the distance between an upper surface of said first cam member and a lower surface of said second cam member being variable according to rotation of said first and second cam member relative to each other, and said first cam member and said second cam member being prevented from rotation relative to each other when said first cam surface and said second cam surface is in engagement with each other; and biasing means for biasing said first cam member and said second cam member toward each other to normally keep said first cam surface and said second cam surface in engagement with each other.

* * * * *